United States Patent [19]

Greskovich

[11] 4,026,344

[45] May 31, 1977

[54] METHOD FOR MAKING INVESTMENT CASTING MOLDS FOR CASTING OF SUPERALLOYS

[75] Inventor: Charles D. Greskovich, Schenectady, N.Y.

[73] Assignee: General Electric Company, Schenectady, N.Y.

[22] Filed: June 23, 1976

[21] Appl. No.: 698,871

[52] U.S. Cl. ..... 164/26
[51] Int. Cl.[2] ..... B22C 9/12
[58] Field of Search ..... 164/25, 26, 138, 361, 164/41; 106/38.3, 38.27, 38.9

[56] References Cited

UNITED STATES PATENTS

| | | | |
|---|---|---|---|
| 2,701,902 | 2/1955 | Strachan | 164/25 X |
| 3,445,250 | 5/1969 | Preece | 106/38.27 X |
| 3,833,385 | 9/1974 | Adelsberg et al. | 106/38.9 |
| 3,839,054 | 10/1974 | Forker et al. | 106/38.9 |
| 3,933,190 | 1/1976 | Fassler et al. | 164/26 |

*Primary Examiner*—John E. Roethel
*Attorney, Agent, or Firm*—Donald M. Winegar; Joseph T. Cohen; Jerome C. Squillaro

[57] ABSTRACT

A metastable mullite phase is formed in the physical structure of investment casting molds by employing alumina flour of a particle size less than 100 microns.

16 Claims, 4 Drawing Figures

METHOD FOR MAKING INVESTMENT CASTING MOLDS FOR CASTING OF SUPERALLOYS

BACKGROUND OF THE INVENTION

1. Field of the Invention

This invention relates to the composition of the material of shell investment molds for casting and directionally solidifying nickel-base superalloys and high-temperature nickel-base eutectic materials which require the mold to be exposed to elevated temperatures greater than from 1680° C to 1700° C for extended periods of time of up to 24 hours.

2. Description of the Prior Art

Shell investment molds are employed to produce castings of a wide variety of alloys with a refractory material, compatible with the alloy being cast, forming the inner mold wall. The secondary or back-up coats usually are composed of a high alumina-silicate refractory of an appropriate grain size to insure production of a useable mold. Long periods of time, up to 10 hours, coupled with high temperatures (1500° – 1600° C) caused undesirable mold defects, such as total collapse after casting the alloys, premature cracking and mold warpage. All of these, of course, produce undesirable and unacceptable castings. Mold-metal reactions, such as "pock marks," were also noted, suggesting that the inner or primary coats became contaminated with excessive amounts of $SiO_2$, $Na_2O$, and other fluxing agents which were not compatible with the superalloy being cast.

In a copending patent application, "Fabrication of Shell Investment Molds," Ser. No. 591,168, and assigned to the same assignee as this patent application, Paul Svec teaches a material composition of at least two different flour grain sizes of fused aluminum and a silica binder. Continued efforts have been directed to develop material compositions which are as good as, or better, than those taught by Mr. Svec and the prior art, particularly a material having more resistance to slumping at elevated temperatures in excess of about 1680° to 1700° C.

An object of this invention is to provide a new and improved process for making shell investment molds for the casting of superalloys which overcomes the deficiencies of the prior art.

Another object of this invention is to provide a new and improved process for making shell investment molds suitable for use in high-temperature mold applications (1680° – 1700° C).

Another object of this invention is to provide a new and improved process for making shell investment molds having excellent resistance to slumping at elevated temperatures in excess of about 1700° C.

A further object of this invention is to provide a new and improved process for making an improved alumina slurry which, upon firing, will withstand the effects of mold-metal reactions at the mold-metal interface, such as required for the directional solidification of nickel-base superalloys and high-temperatures nickel-base eutectic alloys requiring long solidification periods to obtain the desired cast structure.

Other objects of this invention will, in part, be obvious and will, in part, appear hereinafter.

BRIEF DESCRIPTION OF THE INVENTION

In accordance with the teachings of this invention, there is provided a new and improved method for making a shell investment mold suitable for casting superalloy materials therein. The method includes preparing a slurry of mixture of alumina flour having an average particle size of less than about 100 microns and silica of an average particle size of from 16 to 30 millicrons. The composition of the slurry ranges from 65 wt. percent alumina to 73 weight percent alumina balance silica and water. Several coatings of the slurry mixture are applied to a wax pattern of a predetermined shape. An alumina stucco aggregate is disposed on each layer of slurry mixture prior to the application of the next coating. The applied coatings are dried and have an average chemical composition of from 80 weight percent to 96 weight percent alumina, balance silica. The wax pattern is then removed from the mold and the material of the mold is then pre-reacted at an elevated temperature of about 1725° C in an inert atmosphere for a period of up to about 2 hours. A result of this prereacting of the material composition is the formation of mullite in the mold body.

The molds may then be fired again at an elevated temperature of approximately 1800° to 1850° C to form a metastable mullite phase. The formation of this metastable mullite phase imparts superior resistance to sagging to the mold structure. Best results are achieved when the average particle size of the alumina flour is less than 10 microns.

BRIEF DESCRIPTION OF THE PHOTOGRAPHS

DESCRIPTION OF THE INVENTION

Figure 1:
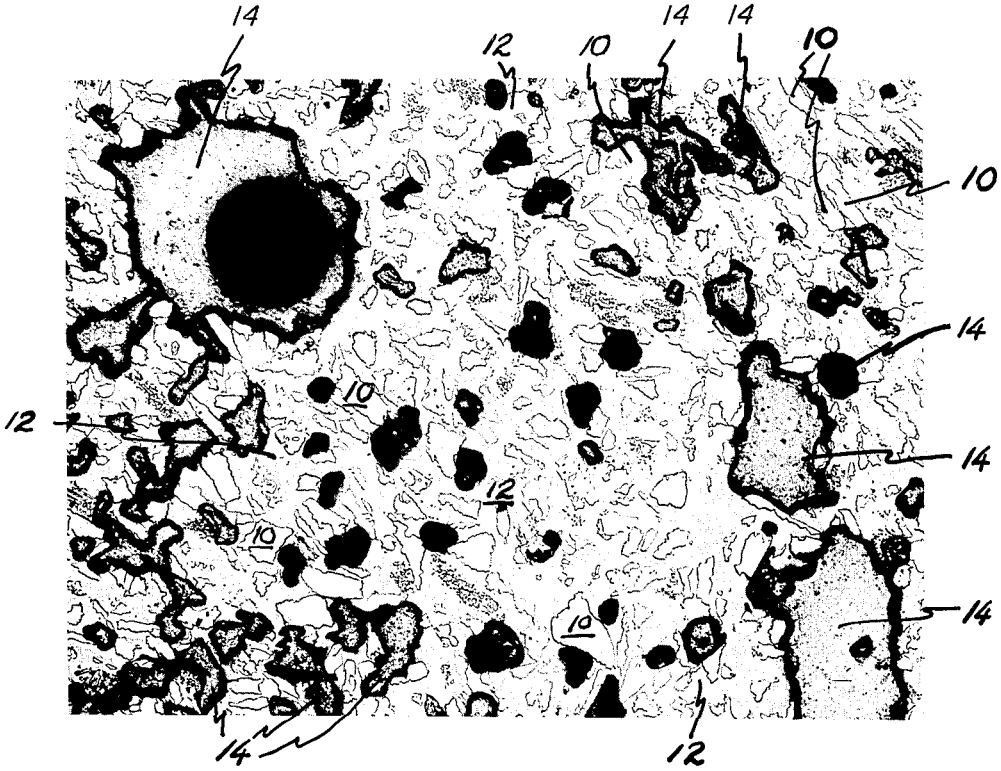
FIG. 1 is a microphotograph, at 250×, of a portion of the microstructure of a mold wherein the average alumina particle size is ~ 35 microns and pre-reacted at 1725° C for 1 hour in an argon atmosphere.

In studying the reactivity of alumina ($Al_2O_3$) flours with silica ($SiO_2$) binder materials, it has been discovered that the average particle size of the $Al_2O_3$ flour has a very pronounced effect on the development of the resulting microstructure when fired. For example, with reference to FIG. 1, a series of molds comprising $Al_2O_3$ flour of an average particle size of about 35 microns and silica binder material were prepared by the conventional economic method of preparing ceramic shell molds by the "lost wax" process. The silica binder was Nalco 1035 and had an average particle size of 16–22 millimicrons. The composition of the binder is 36% by weight silica, 64% by weight water and 0.15% by weight $Na_2O$. To prepare the molds, a slurry of alumina flour and a silica binder is prepared and a wax pattern of a small turbine blade is immersed in, and coated with, the slurry. The ratio of alumina to silica, by weight percent, may vary from 65:35 to 73:27. The ratio employed in the mold of FIG. 1 is 67:33. The silica binder material is a colloidal silica, available commercially containing 36% silica by weight. The colloidal solution is diluted with deionized water to vary the silica content from 36% by weight to 15% by weight. A preferred concentration is of the order of 18% by weight.

The size of the silica material is important. The silica size is in a range of no greater than 1000A as its reactivity with the alumina decreases with increasing particle size.

A wetting agent is added to the slurry to ensure proper wetting of the pattern by the slurry. A non-ionic wetting agent is preferred since it is compatible with the binder material employed. A defoaming agent may be required if excessive foam is noted on the slurry during the mixing operation. If good slurry mixing practices are followed, foaming will not be a serious problem. An addition of from 8 cc to 12 cc of wetting agent per 100 pounds total weight of the slurry will induce good wetting properties to the slurry. A suitable defoaming agent is Antifoam 60 manufactured by the General Electric Company and employed as a direct addition to the slurry in quantities of 0.005% by weight to 0.008% by weight of the slurry.

Preparation of the slurry is performed in a suitable mix apparatus such, for example, as a stainless steel container. Mixing is accomplished with a variable speed, propeller mixer. During mixing, the density of the slurry is adjusted to a range of from 2.35 grams/cc to 2.45 grams/cc. The viscosity of the slurry is adjusted to range from 8 to 10 seconds as determined with a No. 5 Zahn cup. The temperature and humidity of the mix and mold rooms should be carefully monitored in order to control evaporation of water from the slurry.

A wax pattern of a small turbine blade is immersed into an $Al_2O_3$ flour slurry comprises of 67% $Al_2O_3$ by weight and 33% silica binder material by weight. The slurry coated wax pattern is withdrawn from the slurry material and drained. The wet surface of the slurry coated pattern is then sprinkled with a fused $Al_2O_3$ stucco aggregate in a fluidized bed and air dried. The chemical composition of the slurry coat, upon drying and ignoring the stucco coating, is about 88 weight percent $Al_2O_3$ and about 12 weight percent $SiO_2$.

This process is repeated six more times to produce a mold of seven successive layers with a stucco layer in between mutually adjacent coatings. The fused alumina of the first two applied stucco coat layers has an average particle size of 310 microns. Such material is commercially available from refractory manufacturers known to those skilled in the art. The subsequent four stucco coats are of fused alumina having a larger average particle size of approximately 600 microns so that the thickness of the mold may be increased rapidly.

In prepaing the mold of FIG. 1, the wax was removed by a "flash-dewaxing" step by plunging the samples into a gas-fired furnace operating at 1000° ± 20° C and firing for a period of time of about 1.5 hours.

The prepared mold was fired at an elevated temperature of 1725° ± 10° C for a period of time of about 1 hour in an inert atmosphere of argon. The mold cooled to room temperature in 3 hours. The mold was then sectioned and the microstructure studied and evaluated.

You will note in FIG. 1, that the microstructure of the mold is characterized by irregularly shaped $Al_2O_3$ grains 10 (light areas) essentially encapsulated by mullite 12 (light gray areas). The alumina ($Al_2O_3$) grains initially have undergone appreciable dissolution into the $Al_2O_3$ — $SiO_2$ liquid phase 14 (dark gray) until the reaction product, mullite, forms. The phase 14 occurs before the formation of the mullite phase 12.

Further evaluations of molds of this particulate composition wherein $Al_2O_3$ is from 80 weight percent to 96 weight percent, balance $SiO_2$, have proven the capability of the molds to be employed in the directional solidification of superalloy materials. A mold, whose microstructure is as shown in FIG. 1, will withstand temperatures of up to about 1800° C without slumping. However, this capability only is achieved if the materials are pre-reacted at an elevated temperature of from 1700° C to 1750° C for about a period of time of from 1 to 2 hours in order to insure that essentially no liquid phase 14 is present in the microstructure. All of the liquid phase is reacted with the $Al_2O_3$ of the mold material to form mullite 12. The nominal composition of the mullite phase 12, as determined by electron microprobe analysis is from 72.0 to 74.2 weight percent $Al_2O_3$, balance silica. This composition corresponds to the formation of a stable, or "equilibrium" mullite having a melting point of about 1828° C. The molds also caused no problems associated with mold shrinkage at temperatures up to about 1800° C.

A second and third series of molds were prepared in the same manner as the first series. However, in this instance the $Al_2O_3$ flour had an average particle size of the order of 25 microns in the second series and of the order of 13 microns in the third series.

All the molds were fired in the same manner as the first series of molds. Again, an examination of the microstructure revealed the same material structure and chemical composition of the mullite phase as found in the first series. Slump resistance of these molds was measurably better than that of the molds of prior art composition. Again the molds exhibited the desired characteristics of causing no problems associated with mold shrinkage at temperatures up to about 1800° C.

Although these mold compositions exhibit physical characteristics superior to those or prior art composition, some limitations of physical properties were noted. It was discovered that it is essential to completely react the $Al_2O_3$ – $SiO_2$ liquid phase with the $Al_2O_3$ phase as fast as possible to form mullite which is then in chemical equilibrium with $Al_2O_3$. When this reaction is not achieved, the molds undergo sagging above 1800° C when high heating rates, of the order of about 30° C per minute, are employed.

Figure 2:
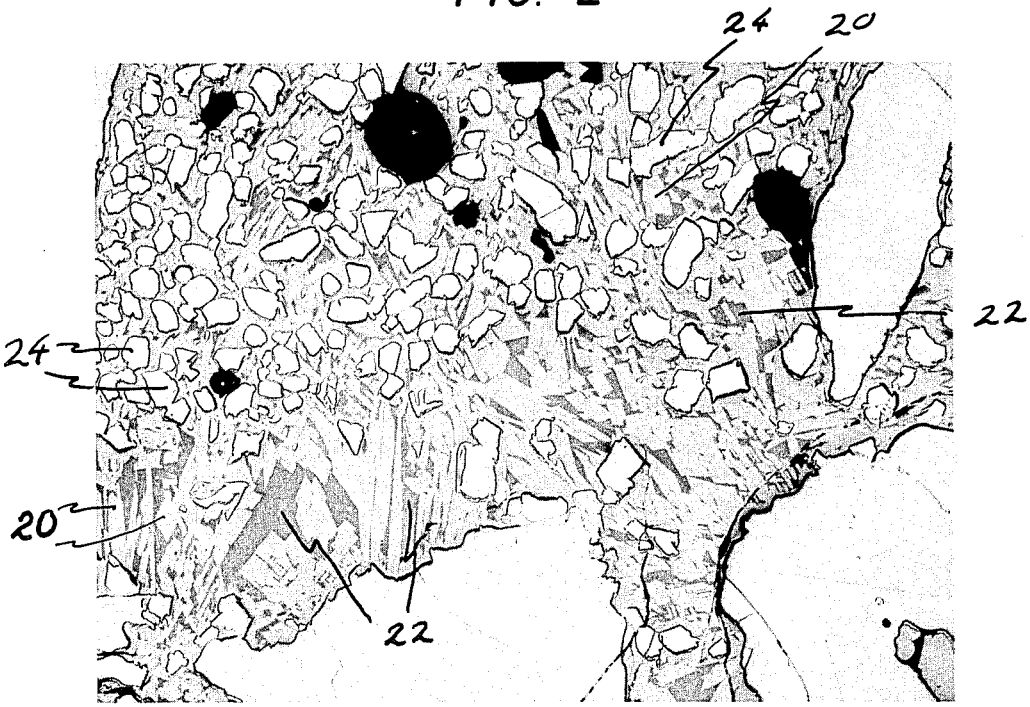
FIG. 2 is a microphotograph, at 250×, of a portion of the microstructure of a mold wherein the average alumina particle size is ~ 13 microns and pre-reacted at 1725° C for 1 hour in an argon atmosphere, fired to about 1890° C for ½ minute and cooled.

Referring now to FIG. 2, there is shown the microstructure of a portion of a mold whose composition includes basically $Al_2O_3$ flour material of an average particle size of about 13 microns. The mullite phase present in the microstructure, even after a pre-reaction period practiced up to 2 hours at 1725° C, undergoes considerable melting at or below about 1890° C. Molds subjected to this elevated temperature range sag appreciably. Upon cooling from about 1900° C, crystallization of "blocky shaped" and lath-like mullite grains 20 (light gray) occurs in the $Al_2O_3$–$SiO_2$ liquid phase 22 (dark gray). Irregularly shaped $Al_2O_3$ grains 24 (white areas) are still present in the structure.

Figure 3:
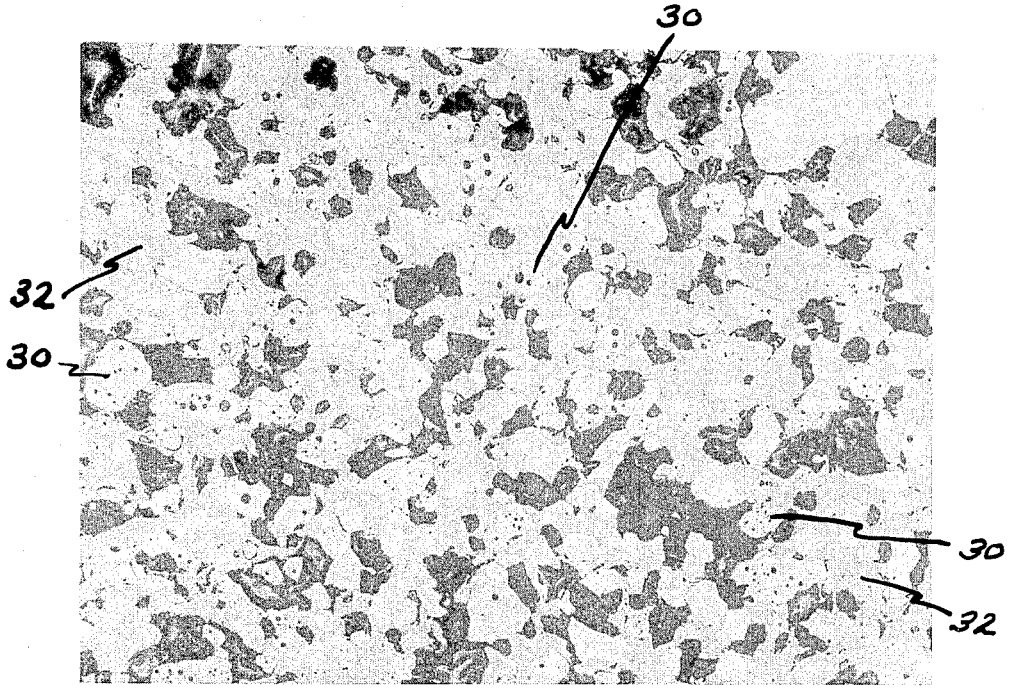
FIG. 3 is a microphotograph, at 250×, of a portion of the microstructure of a mold wherein the average alumina particle size is ~ 3.5 microns and pre-reacted at 1725° C for 1 hour in an argon atmosphere.

Unexpectedly new physical characteristics were discovered when a series of molds were prepared in the same manner as before except that the average particle size of the $Al_2O_3$ flour was about 3.5 microns. With reference now to FIG. 3, the microstructure of the molds, when pre-reacted at about 1725° C as before for about 1 hour, shows a substantial absence of the $Al_2O_3$–$SiO_2$ liquid phase. The $Al_2O_3$ grains 30 (white areas) are completely surrounded by mullite 32 (gray areas).

Investigation of this fourth series of molds has shown that a very little pre-reaction time, of the order of from 10 to 30 minutes, at from 1700° to 1750° C, is necessary to achieve the microstructure of FIG. 3. The mold structure as shown is then suitable, after this pre-reaction firing time, for the casting and directional solidification of superalloy materials in the molds. The molds do not sag under their own weight at temperatures up to the order of 1890° C employing heating rates of the order of 30° C per minute. This was completely unexpected. The molds were suitable for the casting and directional solidification of superalloys therein.

An electron microprobe analysis of the mullite phase 32 revealed the average chemical composition to be from about 77 to about 77.9 weight percent of $Al_2O_3$ and the remainder $SiO_2$. This range of chemical composition corresponds to the formation of a metastable mullite having a melting point of about 1900° C.

Figure 4:
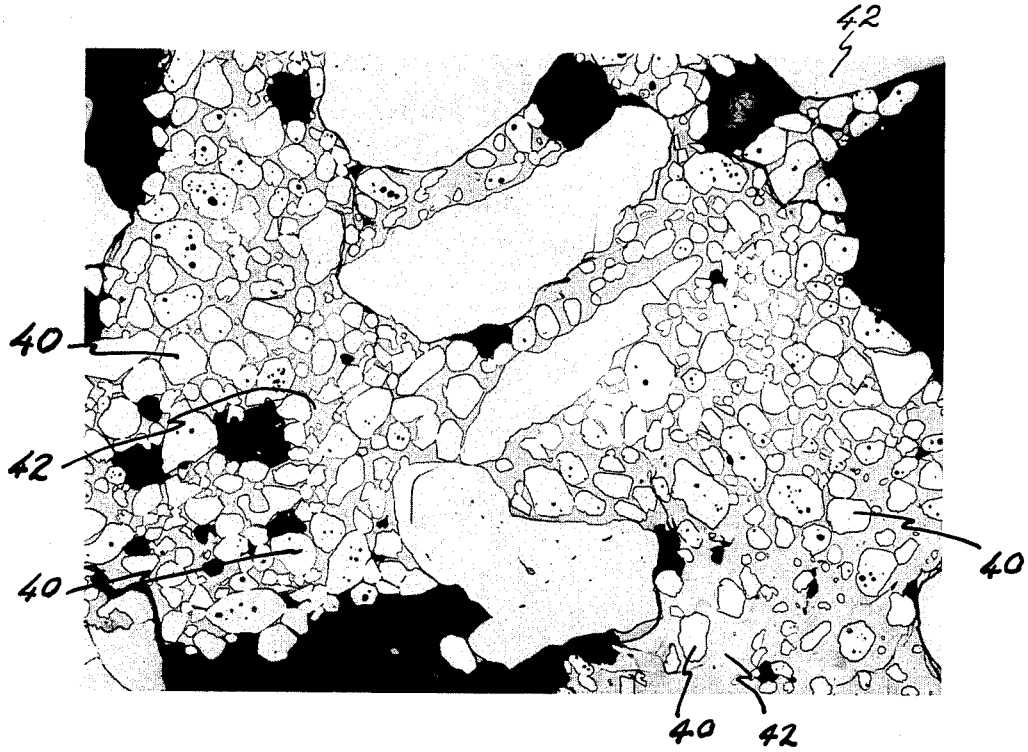
FIG. 4 is a microphotograph, at 250×, of a portion of the microstructure of the mold of FIG. 3 fired at 1890° C for ½ minute.

A portion of the microstructure of the molds of the fourth series ($Al_2O_3$ flour size ~ 3.5 microns) is shown in FIG. 4 after firing at 1890° C for a period of time of ½ minute.

$Al_2O_3$ grains 30 are still well rounded, as in FIG. 3. The metastable mullite phase 32 has not melted as in the case of molds wherein the particle size of the $Al_2O_3$ flour exceeds about 10 microns and formed the "blocky" structure seen in FIG. 3.

The superior microstructure of FIG. 4 enables the molds of the fourth series to resist sagging under their own weight up to about 1890° to 1900° C. At or above about 1900° C the mullite phase 32 begins to melt and the mold starts to sag severely.

Continued experimentation and study of the microstructure of the various size flour series of molds, as determined from the data compiled, indicates that when the average particle size of the $Al_2O_3$ flour is greater than 10 microns, but no greater than the order of 100 microns, the microstructure which one can expect, after prereaction, is that as indicated in FIG. 1.

Further evaluation of the mullite phases 12, 22, 32 and 42 of the respective FIGS. 1, 2, 3 and 4, shows that at temperatures below 1750° C stable mullite forms but at temperatures near or above 1800° C metastable mullite is formed. These results are totally unexpected from the known silica-alumina phase diagrams. Mold structures of the first three series are believed to be composed of both "stable" and ∓metastable" mullite, and considerable melting above about 1800° C and below approximately 1890° C is expected. Consequently, the molds of the first three series sagged under their own weight but they are suitable for casting and solidification of superalloys at temperatures up to about 1800° C.

Microprobe analysis of the metastable mullite phase 42 (FIG. 4) indicates the mullite phase 42 is saturated with $Al_2O_3$. That is to say, mullite solid solution containing ~ 77.5 weight percent $Al_2O_3$, balance $SiO_2$, has been formed. A metastable mullite phase containing 77.5 percent $Al_2O_3$ in solid solution is completely unexpected from the phase diagram based upon the known starting chemical composition.

In summary, alumina-silica molds prepared in accordance with the teachings of this invention show excellent physical properties which enable them to be employed for the casting and solidification of the superalloys. When the average particle size of the alumina flour is of the order of 10 microns to less than about 100 mircons, and the mold material is pre-reacted for about 1 to 2 hours, the molds are suitable for use up to about 1800° C.

However, when the alumina flour particle size is of the order of, or less than, about 10 microns, the prereaction time of the material of the molds is reduced to a period of from 10 to 30 minutes. The pre-reacted or fired molds thereafter are suitable for use in the directional solidification of superalloys at temperatures up to the order of about 1875° C.

It is believed that the superior physical properties derived from the use of alumina flours of an average particle size less than the order of about 10 microns is caused by the high specific surface area available for reaction with the silica. The chemical reaction time is therefore substantially reduced over that required with larger particle size alumina flours.

The preferred embodiment of this invention was practiced in preparing a series of molds to cast a melt of a superalloy metal therein. Thereafter, the cast metal was directionally solidified in the mold. The superalloy was a high nickel content metal known in the trade as NiTaC–13. The metal, as cast, had the following nominal chemical composition:

Nickel — 63.4%
Chromium — 4.4%
Cobalt — 3.3%
Aluminum — 5.4%
Tungsten — 3.1%
Rhenium — 6.2%
Vanadium — 5.6%
Tantalum — 8.1%
Carbon — 0.48%

The casting temperature was 1650° ± 50° C. Directional solidification of the cast metal was practiced for 24 hours.

All of the molds showed excellent service life. All the castings were of commercial quality and required little final finishing of the surfaces. No detrimental metal-mold interface reaction was noted.

I claim as my invention:

1. A method for making a shell investment mold comprising the steps of a. preparing a slurry of a mixture of alumina flour, having an average particle size of less than about 100 microns, and silica of an average particle size less than about 1000A, the composition of the slurry averaging from 65 to 73 weight percent alumina;

b. applying a coating of the slurry mixture to a wax pattern of a predetermined shape of a metal to be cast in the mold;

c. applying a coating of an alumina stucco aggregate on the slurry coating;

d. drying the material of the slurry coating and stucco coating;

e. repeating steps (b), (c) and (d) as often as necessary to apply a predetermined number of layers, disposed one upon the other, of the slurry composition mixture and interdisposed stucco coating on the pattern;

f. removing the pattern from the mold;

g. heating the material composition of the mold to an elevated temperature of from 1700° to 1825° C in an inert atmosphere for a period of time of up to about 2 hours, and h. reacting the alumina and silica with each other to form mullite.

2. The method of claim 1 wherein the average particle size of the alumina flour is greater than about 10 microns, and heating the material composition forms a microstructure which is one selected from the group consisting of irregular shaped alumina grains in a mixture of an alumina-silica liquid phase and a mullite phase and equiaxed alumina grains surrounded by mullite.

3. The method of claim 2 wherein the heating of the material is practiced at an elevated temperature range of from 1700° to 1725° C to form a microstructure of irregular shaped alumina grains in a mixture of an alumina-silica liquid phase and a mullite phase which is a stable mullite phase of an average chemical composition of the stable mullite phase is from about 72 weight percent alumina to about 74 weight percent alumina, balance silica, having a melting point range from about 1825° to 1830° C.

4. The method of claim 2 wherein the heating of the material is practiced at an elevated temperature range of from about 1800° to 1825° C to form a microstructure of equiaxed alumina grains surrounded by mullite which is, in part, of the stable mullite phase and, in part, the metastable mullite phase.

5. The method of claim 1 wherein the average particle size of the alumina flour is less than about 10 microns.

6. The method of claim 5 wherein the heating of the material is practiced at an elevated temperature of about 1725° C for a period of time of up to about 1 hour to produce a material having a microstructure of equiaxed grains of alumina completely surrounded by a stable mullite phase and a substantial absence of the alumina-silica liquid phase.

7. The method of claim 6 wherein the average chemical composition of the stable mullite phase is from 72 to 74 weight percent alumina, balance silica.

8. The method of claim 5 wherein the heating of the material is practiced at an elevated temperature of at least about 1800° C to produce a material having a microstructure of equiaxed grains of alumina completely surrounded by a metastable mullite phase and a substantial absence of the alumina-silica liquid phase.

9. The method of claim 8 wherein the average chemical composition of the metastable mullite phase is from 77 to 78 weight percent alumina, balance silica.

10. The method of claim 7 wherein the elapsed time at the elevated temperature is less than the order of 10 minutes.

11. The method of claim 6 wherein the heating of the material of the mold is practiced prior to the casting of the metal into the mold.

12. The method of claim 6 wherein the heating of the material of the mold is practiced simultaneously with a process embodying the casting of a melt of metal in the mold and solidification of the same therein thereafter.

13. The method of claim 4 wherein the average chemical composition of the metastable mullite phase is from 77 to 78 weight percent alumina, balance silica.

14. The method of claim 4 wherein the material is heated first at the elevated temperature range of from 1700° to 1725° C and subsequently, as a separate process step, heated at the elevated temperature range of from about 1800° to 1825° C.

15. The method of claim 4 wherein the melting point of the metastable mullite phase is of the order of 1900° C.

16. The method of claim 9 wherein the melting point of the metastable mullite phase is of the order of 1900° C.

* * * * *